US007292220B2

(12) United States Patent
Choi et al.

(10) Patent No.: US 7,292,220 B2
(45) Date of Patent: Nov. 6, 2007

(54) FERROELECTRIC LIQUID CRYSTAL DISPLAY AND METHOD OF DRIVING THE SAME

(75) Inventors: Suk Won Choi, Anyang-shi (KR); Su Seok Choi, Hanam-shi (KR); Jang Jin Yoo, Seoul (KR); Moo Jong Lim, Seoul (KR)

(73) Assignee: LG.Philips LCD. Co., Ltd., Seoul (KR)

( * ) Notice: Subject to any disclaimer, the term of this patent is extended or adjusted under 35 U.S.C. 154(b) by 221 days.

(21) Appl. No.: 10/017,585

(22) Filed: Dec. 18, 2001

(65) Prior Publication Data

US 2002/0084973 A1 Jul. 4, 2002

(30) Foreign Application Priority Data

Dec. 29, 2000 (KR) ..... 10-2000-85287

(51) Int. Cl.
*G09G 3/36* (2006.01)

(52) U.S. Cl. ..... 345/102; 345/97

(58) Field of Classification Search ..... 345/87–102
See application file for complete search history.

(56) References Cited

U.S. PATENT DOCUMENTS

| | | | | |
|---|---|---|---|---|
| 6,392,620 | B1 * | 5/2002 | Mizutani et al. | 345/88 |
| 6,570,554 | B1 * | 5/2003 | Makino et al. | 345/102 |
| 6,762,740 | B1 * | 7/2004 | Kimura | 345/102 |
| 2002/0000960 | A1 * | 1/2002 | Yoshihara et al. | 345/87 |
| 2002/0008683 | A1 * | 1/2002 | Makino et al. | 345/88 |
| 2003/0058210 | A1 * | 3/2003 | Yamazaki et al. | 345/89 |

* cited by examiner

*Primary Examiner*—David L. Lewis
(74) *Attorney, Agent, or Firm*—McKenna, Long & Aldridge LLP

(57) ABSTRACT

A ferroelectric liquid crystal display and a fabricating method thereof that is capable of improving light efficiency by preventing light efficiency deterioration due to the low voltage holding ratio of a ferroelectric liquid crystal. The ferroelectric liquid crystal display supplies red, green and blue data signals to each of the liquid crystal cells and is in a stand-by state during a responding period of liquid crystal, and then sequentially generates red, green and blue lights corresponding to each of the red, green and blue data signals. With this configuration, deterioration in brightness due to the low voltage holding ratio of the ferroelectric liquid crystal can be prevented and the light efficiency can be increased.

20 Claims, 11 Drawing Sheets

| | | | | | |
|---|---|---|---|---|---|
| R | G | B | R | G | B |
| R | G | B | R | G | B |

FERROELECTRIC LIQUID CRYSTAL DISPLAY AND METHOD OF DRIVING THE SAME

This application claims the benefit of Korean Patent Application No. 2000-85287, filed on Dec. 29, 2000, the entirety of which is hereby incorporated by reference for all purposes as if fully set forth herein.

BACKGROUND OF THE INVENTION

1. Field of the Invention

This invention relates to a ferroelectric liquid crystal display, and more particularly to a ferroelectric liquid crystal display and a driving method that is capable of preventing deterioration of light efficiency caused by a low voltage holding ratio.

2. Description of the Related Art

Generally, a liquid crystal display (LCD) controls light in accordance with a liquid crystal alignment state to thereby display a desired picture on a screen. A liquid crystal used for such a LCD is in a neutral phase between a liquid state and a solid state, thereby having both a fluidity and an elasticity. In a thermodynamic phase transition process of the liquid crystal, for example, a liquid crystal having a smectic C phase is rotated along a smectic layer, taking a layer structure having the same electrical and magnetic property. The smectic C phase liquid crystal is rotated along an outer line of a virtual cone.

The smectic C phase liquid crystal has a characteristic of making a spontaneous polarization irrespectively of an external electric field. This type of liquid crystal is usually referred to as ferroelectric liquid crystal (FLC). The FLC has been actively studied because it has a fast response speed as a result of its spontaneous polarization characteristic. Accordingly, it has an ability to realize a wide viewing angle without a special electrode structure and a compensating film. In addition, the FLC includes a deformed helix FLC mode, a surface stabilized FLC mode, an anti-FLC mode, a V-type FLC mode and a half V-type FLC mode, etc. The V-type FLC mode and the half V-type FLC mode modes will be described.

FIG. 1 shows an alignment state of a liquid crystal cell in the V-type FLC mode.

Referring to FIG. 1, the liquid crystal cell, in the V-type FLC mode, includes an upper substrate 1 on which a common electrode 3 and an alignment film 5 are disposed, a lower substrate 11 on which a TFT array 9 including a pixel electrode and an alignment film 7, and a liquid crystal 13 injected between the upper and lower substrates 1 and 11. The alignment films 5 and 7 are aligned into a desired state by a rubbing method. The injected liquid crystal 13 forms a smectic layer, taking a layer structure, and is arranged into a phase having a desired slope with respect to a plane perpendicular to the smectic layer. The liquid crystal 13 has a desired inclination angle with respect to an aligned direction of the alignment film and is aligned such that the adjacent smectic layers have opposite polarities with respect to each other.

A transmissivity according to a voltage of the V-type FLC mode liquid crystal cell is shown in FIG. 2. The liquid crystal 13 within the V-type FLC mode liquid crystal cell responds to positive and negative voltages applied thereto. Since the transmissivity is suddenly changed according to an application of the positive and negative voltages, a transmissivity curve according to a voltage has a V shape. As shown in FIG. 2, transmissivity is increased as a positive voltage increases, whereas transmissivity is decreased as a negative voltage increases.

FIG. 3 shows an alignment state of a liquid crystal cell in the half V-type FLC mode.

In FIG. 3, a liquid crystal 15 within the half V-type FLC mode liquid crystal cell injected between the upper substrate 1 and the lower substrate 11 forms a smectic layer taking a layer structure. The liquid crystal 15 is aligned at a desired inclination angle with respect to an alignment treatment direction of the alignment films 5 and 7 such that the adjacent smectic layers have a different polarity, unlike the liquid crystal 13 in the V-type FLC mode. A half V-type mode liquid crystal can be implemented by applying a positive or negative electric field in advance while at the same time lowering its temperature into a temperature having a smectic phase. The half V-type FLC mode liquid crystal 15 formed in this manner responds to only one of the applied positive and negative voltages. Thus, as seen from FIG. 4, a transmittance curve according to a voltage of a liquid crystal cell in the half V-type FLC mode has a half V shape. A T-V characteristic in FIG. 4 represents the situation when a negative voltage is used to make an initial uniform alignment. In this case, transmissivity is almost not increased upon application of a negative voltage, whereas it is increased in accordance with an increase in a positive voltage. The opposite is true when a positive voltage is used to make an initial uniform alignment, that is, transmissivity is increased in accordance with an increase in a negative voltage.

A thermodynamic phase transition process of the half V-type FLC mode liquid crystal 15 is as follows:

Isotropic nematic (N*) phase→smectic C* (Sm C*) phase
crystal

As the temperature gradually decreases, the phase transition process of a liquid crystal goes from left to right as shown in the above thermodynamic phase transition.

For example, the liquid crystal 15 is aligned in parallel to a rubbing direction, when its temperature is slowly lowered to reach a temperature having a nematic phase after the liquid crystal 15 is injected into the liquid crystal cell at a temperature having an isotropic phase. If an electric field is applied to the interior of the cell while the temperature is slowly lowered, the liquid crystal 15 is phase-changed into a smectic phase. The direction of a spontaneous polarization of the liquid crystal 15 generated at this time is arranged in such a manner to be consistent with that of an electric field formed at the interior of the cell. As a result, when the liquid crystal 15 within the liquid crystal cell is subjected to a parallel alignment treatment, it takes a molecule arrangement in the spontaneous polarization direction, which is consistent with the direction of an electric field applied in said phase transition process of two possible molecule arrangement directions, thereby having a uniform alignment state.

Molecular arrangement in the spontaneous polarization direction will be described in detail with reference to FIG. 5 and FIG. 6 below. First, as seen from FIG. 5, if a negative electric field E(−) is applied to the alignment of the liquid crystal 15, then a spontaneous polarization direction of the liquid crystal 15 that is identical to the electric field direction is made, thus providing a uniform alignment. In the liquid crystal cell, as shown in FIG. 6, a liquid crystal arrangement is changed upon application of a positive electric field E(+), while a liquid crystal arrangement is not changed upon application of a negative electric field E(−). In order to utilize a response characteristic to an electric field of the liquid crystal 15, polarizers perpendicular to each other are arranged at the upper and lower portions of the liquid crystal cell. At this time, a transmission axis of one polarizer is arranged to be consistent with an initial liquid crystal alignment direction. In the liquid crystal cell having the above-mentioned arrangement, a transmission curve according to a voltage application has a half V shape as shown in FIG. 4 experimentally.

With respect to a negative electric field E(−), a liquid crystal arrangement is not changed to shut out a light. Otherwise, with respect to a positive electric field E(+), a liquid crystal arrangement is changed to transmit light. In this case, as a positive electric field E(+) increases, a transmittance also is increased.

Referring to FIG. 7, the ferroelectric LCD includes an upper substrate 102 on which a color filter array 104, a common electrode 106 and an alignment film 107 that has undergone an alignment treatment are sequentially disposed. A lower substrate 114, on which a pixel electrode 112 including a TFT array, and an alignment film 110 that has undergone an alignment treatment are sequentially disposed. Spacers (not shown) are provided between the upper substrate 102 and the lower substrate 114. Ferroelectric liquid crystals 108 are injected into an inner space between the upper and lower substrate 102 and 114 defined by the spacers. Polarizers 100 and 120 are attached at the outsides of the upper and lower substrates 102 and 114. A backlight 116 for irradiating a light and a backlight driver (not shown) for controlling a turn-on of the backlight 116 are provided.

The backlight driver applies an electrical signal to the backlight 116 to generate light. The backlight 116 creates a white light in response to the electrical signal from the backlight driver. The light generated from the backlight 116 is converted into a surface light source to be applied uniformly incident to the liquid crystal display panel. The white light from the backlight 116 is transmitted or blocked depending on an alignment state of the ferroelectric liquid crystals 108. For example, a voltage is applied to a certain pixel to generate a voltage difference between a pixel electrode 112 and a common electrode 106. Accordingly, a rotation angle of the liquid crystal molecules is changed and a transmittance is controlled in accordance with the changed rotation angle of the liquid crystal molecules, thereby implementing various black and white gray scales.

The light generated from such a backlight 116 transits the red, green and blue color filters 104 on the upper substrate 102 to have saturation and brightness. As illustrated in FIG. 8, one pixel has 3 sub-pixels for realizing a picture. The each sub-pixel corresponds to the pixel cell to sequentially form the red, green, blue color filter 104. The color filter 104 selectively transmits the red, green and blue wavelength corresponding to the specific wavelength of the white light to realize the colorful picture. The black matrix 118 is built between each of color filters 104 for each color not to interfere.

In the meantime, FIG. 9 shows the characteristics of the voltage holding ratio (VHR) of a ferroelectric liquid crystal. VHR refers to the ratio of holding the voltage charge in a liquid crystal cell after a voltage is applied to the liquid crystal cell. In other words, because the driving voltage is not applied to the liquid crystal cell during the non-selected period of LCD driving, the liquid crystal cell holds a floating state. The electric charge that is charged in the liquid crystal cell during the selected period upon the application of the driving voltage, is discharged to the outside of the liquid crystal cell during the non-selected period. VHR refers to the degree of the liquid crystal cell sustaining the voltage charge in the floating state. VHR characteristics of the ferroelectric liquid crystal is described as follows.

The ferroelectric liquid crystal has the characteristics of the spontaneous polarization, i.e., it has a polarity when a driving voltage is not applied. Thus, it rapidly restores the elasticity after the driving voltage has been applied. The ferroelectric liquid crystal is rotated to the position where the light is transmitted by the driving voltage initially supplied. However, the voltage charged to the ferroelectric liquid crystal drops below 50% of the voltage charge initially supplied in accordance with the characteristics of the depolarization of the liquid crystal. The voltage decreased is sustained for one frame period. The ferroelectric liquid crystal is rotated to the position where light is not transmitted by such a voltage decrease. Consequently, the time sustaining the position of the liquid crystal molecule transmitting the light, becomes less for the brightness to drop.

As a method for improving the VHR characteristics of the ferroelectric liquid crystal, the storage capacitance in the TFT design has been increased.

FIG. 10 shows the relationship of the VHR and the aperture ratio according to the storage capacitance (Cst).

Referring to FIG. 10, the VHR increases but the aperture ratio decreases when the size of the storage capacitance increases. In other words, when the size of the storage capacitor is increased to increase the value of the storage capacitance, the size of storage capacitor affects the pixel area to which the light is transmitted to thereby reduce the aperture ratio.

Accordingly, there is a limitation in the indefinite increase of the storage capacitance size to improve the VHR characteristics.

Also, decreasing the size of spontaneous polarization of the ferroelectric liquid crystal has been used as another way to improve the VHR characteristics of the ferroelectric liquid crystal.

FIG. 11 shows the relationship according to the spontaneous polarization of the ferroelectric liquid crystal.

Referring to FIG. 11, the VHR decreases when the spontaneous polarization increases. In other words, the VHR characteristics can be improved by decreasing the spontaneous polarization of the ferroelectric liquid crystal. However, the response time of the ferroelectric liquid crystal described in the Equation 1 should be considered when changing the size of the spontaneous polarization of the ferroelectric liquid crystal for the improvement of the characteristics of the VHR.

$$\tau=\gamma/(P*E) \qquad \text{[Equation 1]}$$

In Equation 1, $\tau$ is the response time of the liquid crystal, $\gamma$ is the rotational viscosity of the liquid crystal, P is the spontaneous polarization of the liquid crystal, E is the electric field.

As shown in the Equation 1, the response time of the ferroelectric liquid crystal has an inverse proportional relationship with the size of the spontaneous polarization of the ferroelectric liquid crystal. In other words, the response time of the ferroelectric liquid crystal decreases when the degree of the spontaneous polarization increases in the ferroelectric liquid crystal. An increase in VHR results in an increase in the leakage of the voltage charged to the liquid crystal. Whereas, the VHR decreases when the degree of the spontaneous polarization of the ferroelectric liquid crystal increases, and the response time of the ferroelectric liquid crystal increases. Therefore, when the size of the spontaneous polarization of the ferroelectric liquid crystal decreases the response time of the ferroelectric liquid crystal should also be considered.

SUMMARY OF THE INVENTION

Accordingly, the present invention is directed to ferroelectric liquid crystal display and a driving method thereof that substantially obviates one or more of the problems due to limitations and disadvantages of the related art.

It is an advantage of the present invention to provide a ferroelectric liquid crystal display and a driving method thereof that is capable of improving light efficiency by preventing the light efficiency deterioration that results from a low voltage holding ratio.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other advantages of the invention, a ferroelectric liquid crystal display according to one aspect of the present invention includes a liquid crystal panel in which a liquid crystal cell is formed at the intersection of the gate line and data line; a data processor for supplying red, green and blue data signals to each of liquid crystal cells; and a backlight that stands by during the responding period of the liquid crystal after the supplying period of the red, green and blue data signals and sequentially generates red, green and blue lights corresponding to the red, green and blue data signals.

The liquid crystal panel includes a upper substrate on which a common electrode and an alignment film are sequentially disposed; a lower substrate on which a thin film transistor array, a pixel electrode and an alignment film are sequentially disposed, and a ferroelectric liquid crystal injected between the upper substrate and the lower substrate.

The backlight includes a backlight driver for supplying an electrical signal to generate the red, green and blue lights, and a backlight controller supplying a control signal to generate the red, green and blue lights for a frame period.

The ferroelectric liquid crystal responds to the color data signal after the color data signal is supplied to the liquid crystal cell.

In another aspect of the present invention, a method of driving a ferroelectric liquid crystal display includes sequentially supplying the red, green and blue data signals to a liquid crystal cell formed at the intersection of the gate line and the data line of the liquid crystal panel; the liquid crystal supplying the red, green and blue data signals; and sequentially generating the red, green and blue lights corresponding to each of the red, green and blue data signals after the responding period of the liquid crystal panel.

The backlight is in a stand-by state during the responding period of the liquid crystal.

The red, green and blue data signals sequentially are supplied to each of the liquid crystal cells at least once or more during a frame period.

During a frame period, the red light is irradiated after the red data signal is supplied to the liquid crystal cell, the green light is irradiated after the green data signal is supplied to the liquid crystal cell, and the blue light is irradiated after the blue data signal is supplied to the liquid crystal cell.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

Figure 1:
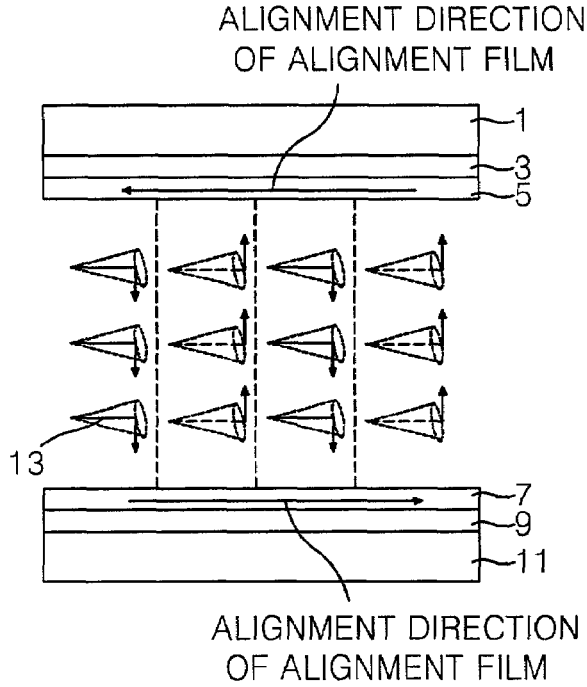
FIG.1 CONVENTIONAL ART
Figure 2:
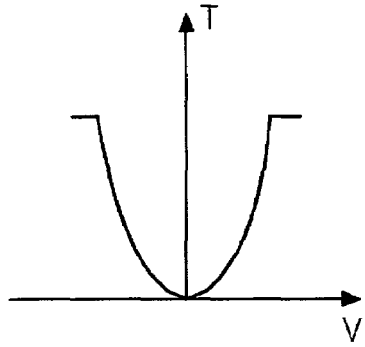
FIG.2 CONVENTIONAL ART
Figure 3:
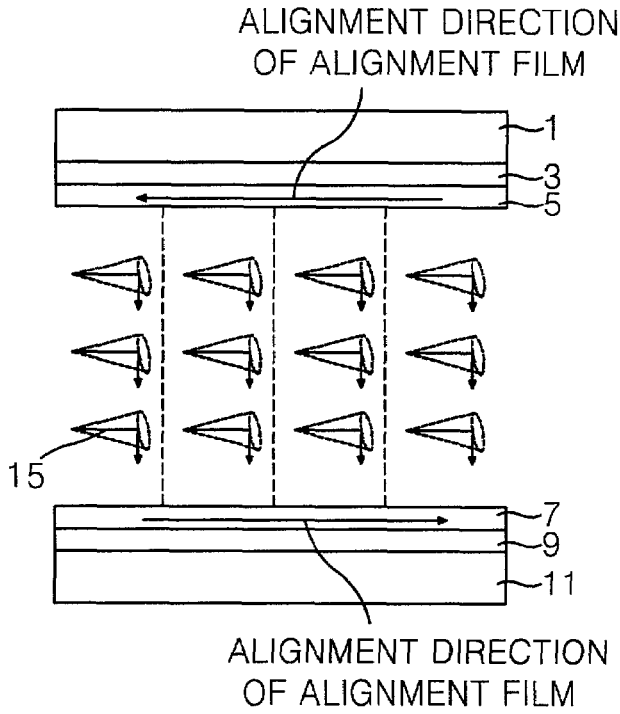
FIG.3 CONVENTIONAL ART
Figure 4:
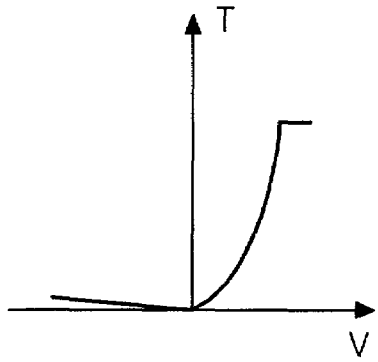
FIG.4 CONVENTIONAL ART
Figure 5:
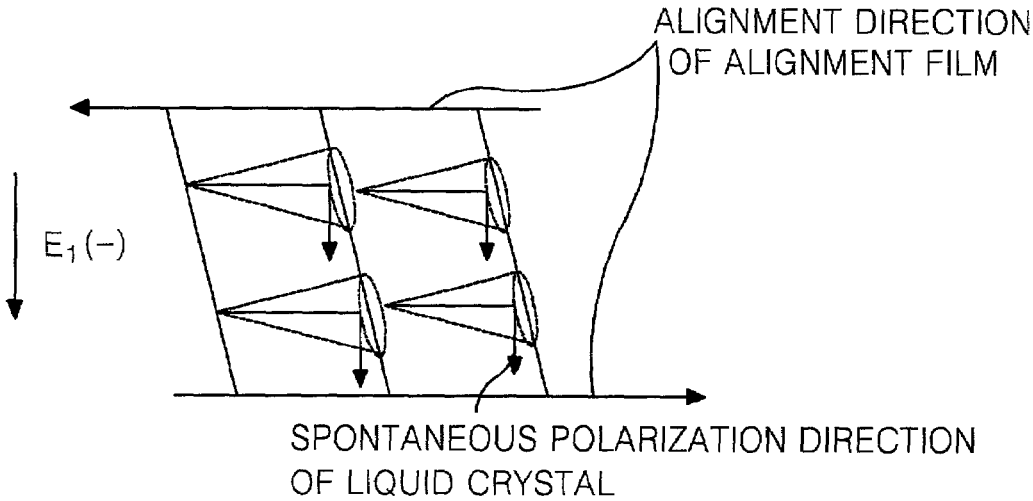
FIG.5 CONVENTIONAL ART
Figure 6:
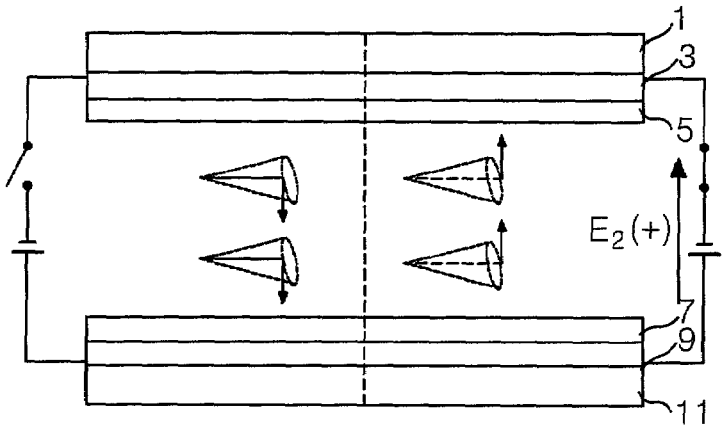
FIG.6 CONVENTIONAL ART
Figures 7, 8:
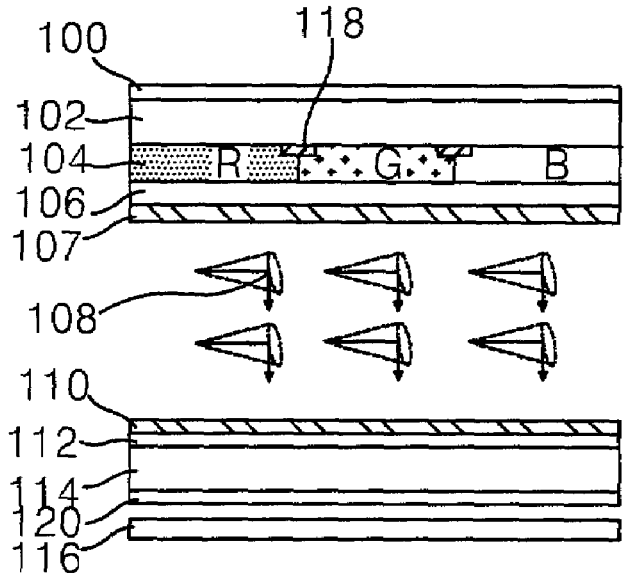
FIG. 7 CONVENTIONAL ART
FIG. 8 CONVENTIONAL ART

These and other objects of the invention will be apparent from the following detailed description of the embodiments of the present invention with reference to the accompanying drawings, in which:

FIG. 1 illustrates an alignment state of a liquid crystal cell in a conventional V-type FLC mode;

FIG. 2 is a graph representing a transmittance according to a voltage of the conventional V-type FLC mode liquid crystal cell;

FIG. 3 illustrates an alignment state of a liquid crystal cell in a conventional half V-type FLC mode;

FIG. 4 is a graph representing a transmittance according to a voltage of the conventional half V-type FLC mode liquid crystal cell;

FIG. 5 illustrates a method of applying an electric field to implement the conventional half V-type FLC mode liquid crystal cell;

FIG. 6 depicts a motion of a liquid crystal upon application of a voltage to the conventional half V-type FLC mode liquid crystal cell;

FIG. 7 is a sectional view of the conventional ferroelectric liquid crystal.

FIG. 8 illustrates the color filter arrangement of the conventional ferroelectric liquid crystal cell shown in FIG. 7.

Figure 9:
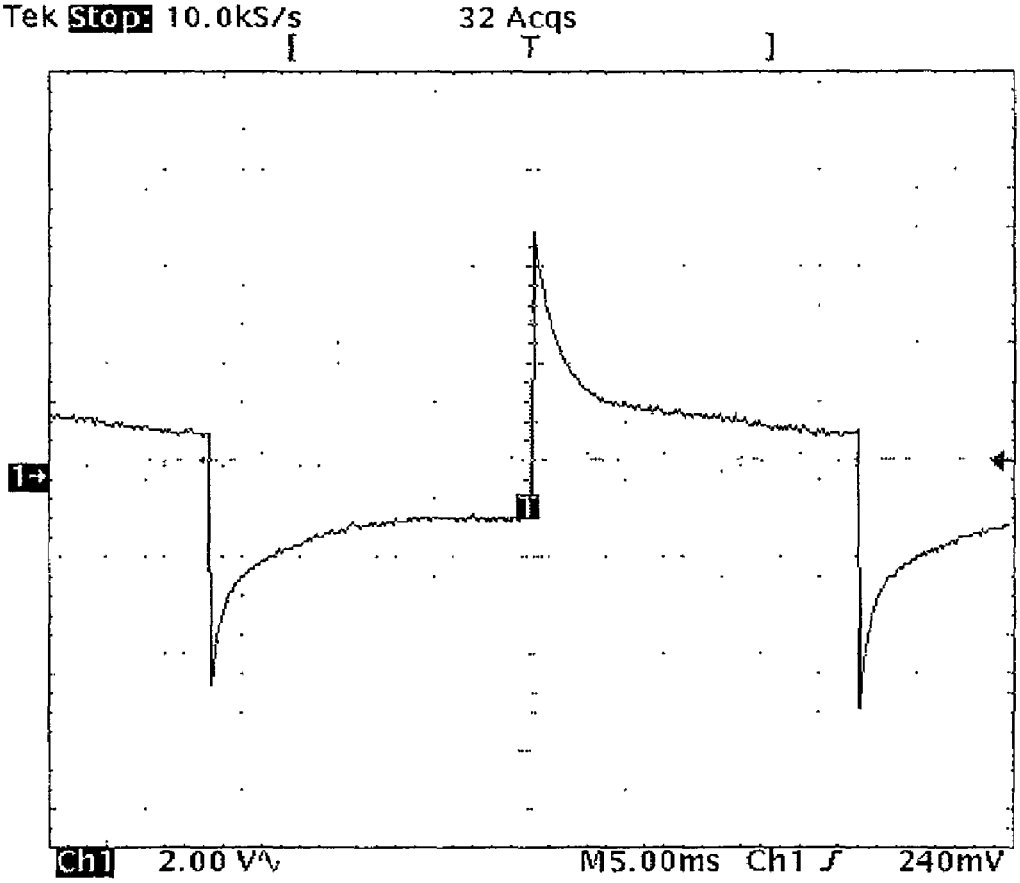
FIG.9 CONVENTIONAL ART

FIG. 9 is a graph representing the characteristics of the voltage holding ratio (VHR) of the conventional ferroelectric liquid crystal shown in FIG. 7.

Figure 10:
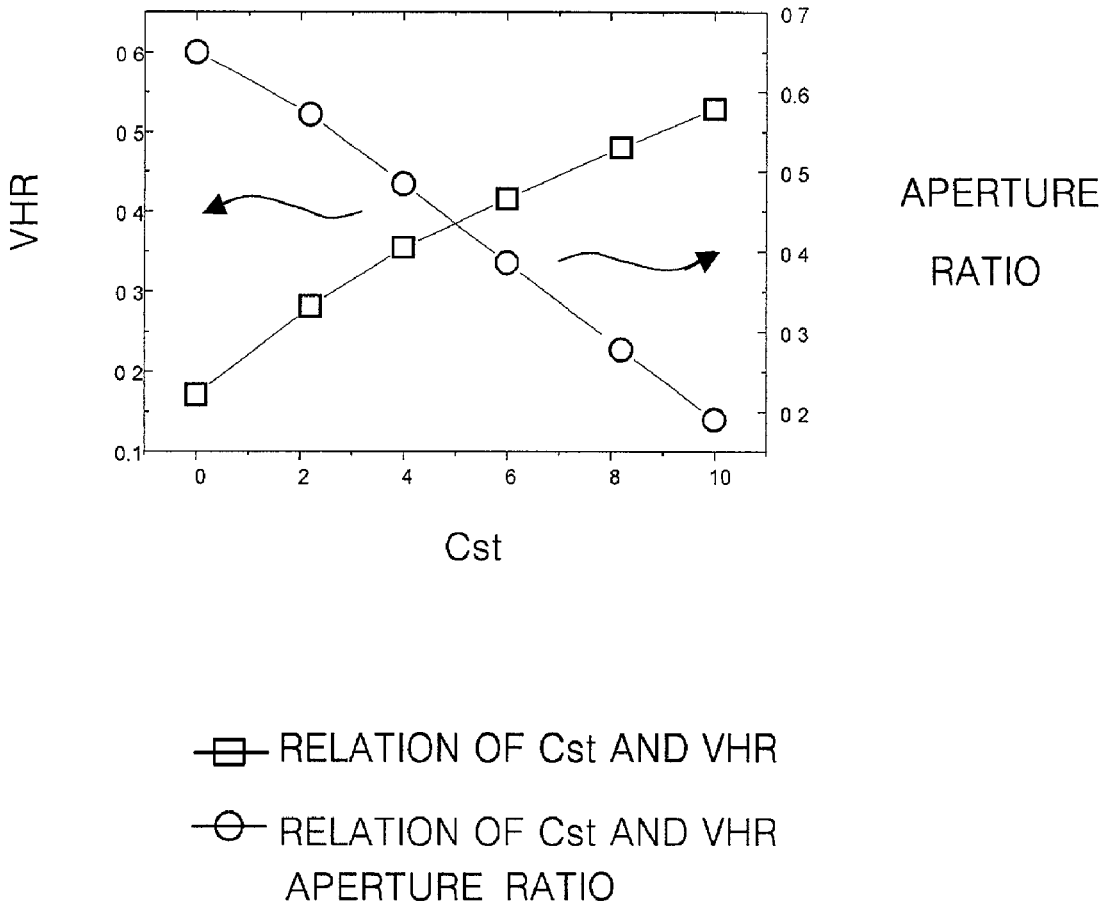
FIG.10 CONVENTIONAL ART

FIG. 10 is a graph representing the characteristics of the VHR and the aperture ratio according to the storage capacitance.

Figure 11:
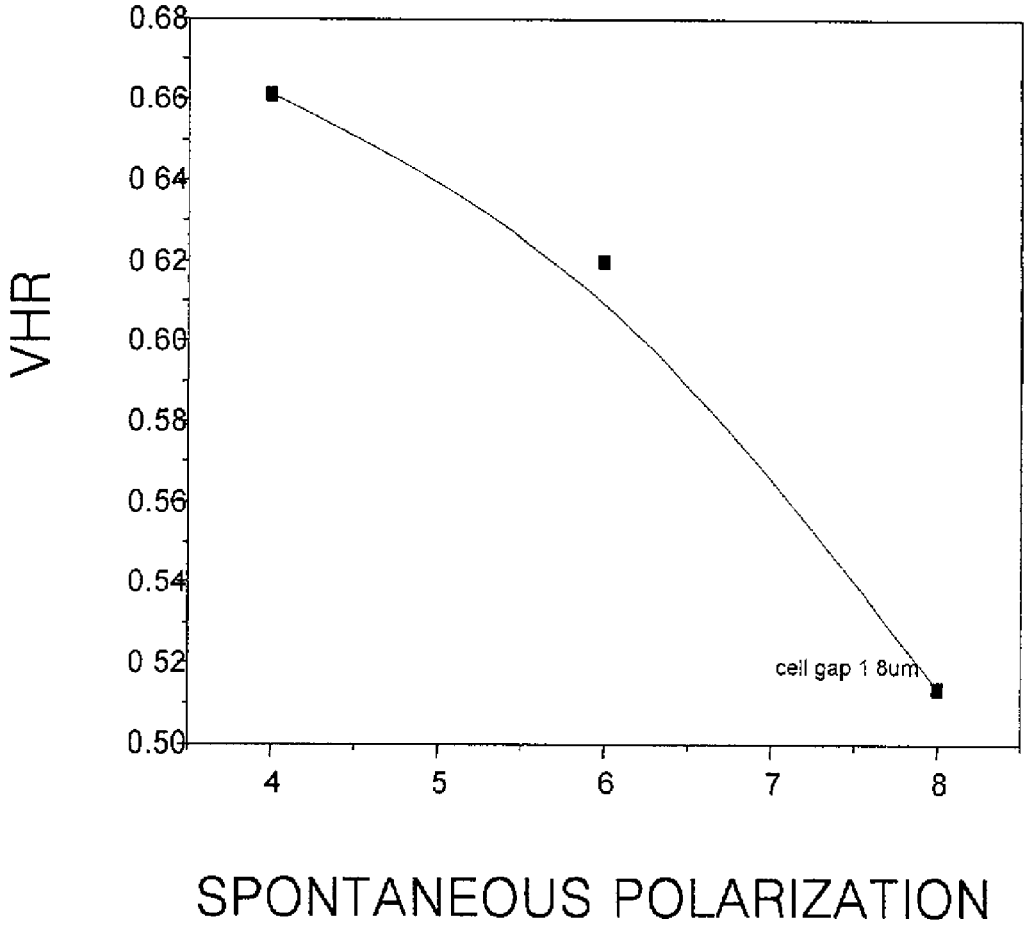
FIG.11 CONVENTIONAL ART

FIG. 11 is a graph representing the relationship of the VHR according to the spontaneous polarization of the ferroelectric liquid crystal.

Figure 12:
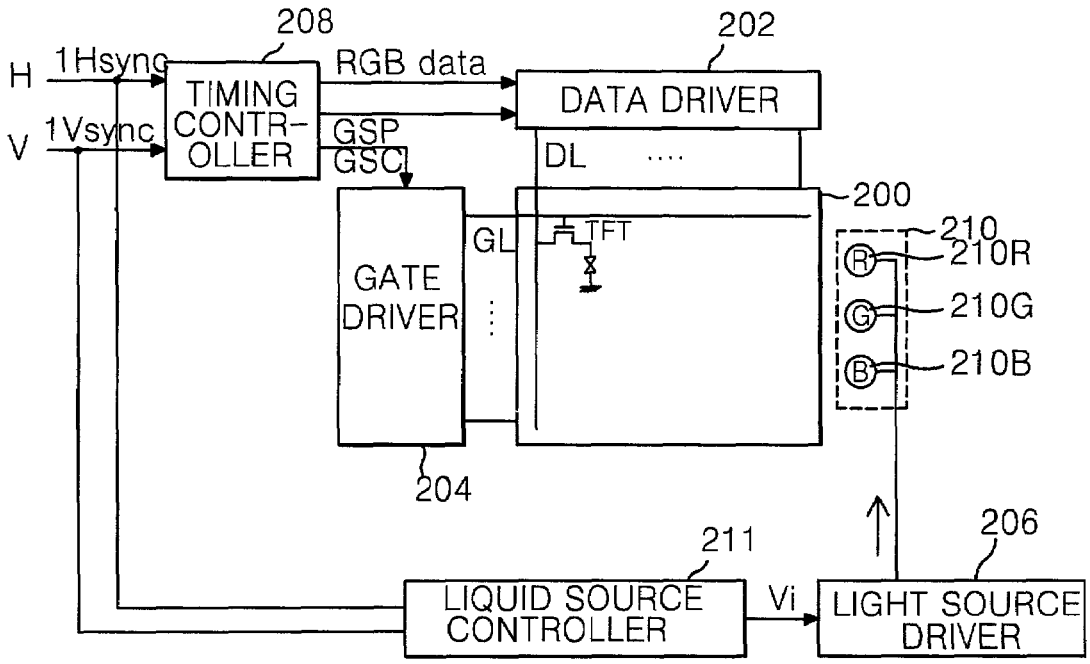

FIG. 12 illustrates the ferroelectric liquid crystal in accordance with an embodiment of the present invention.

Figure 13:
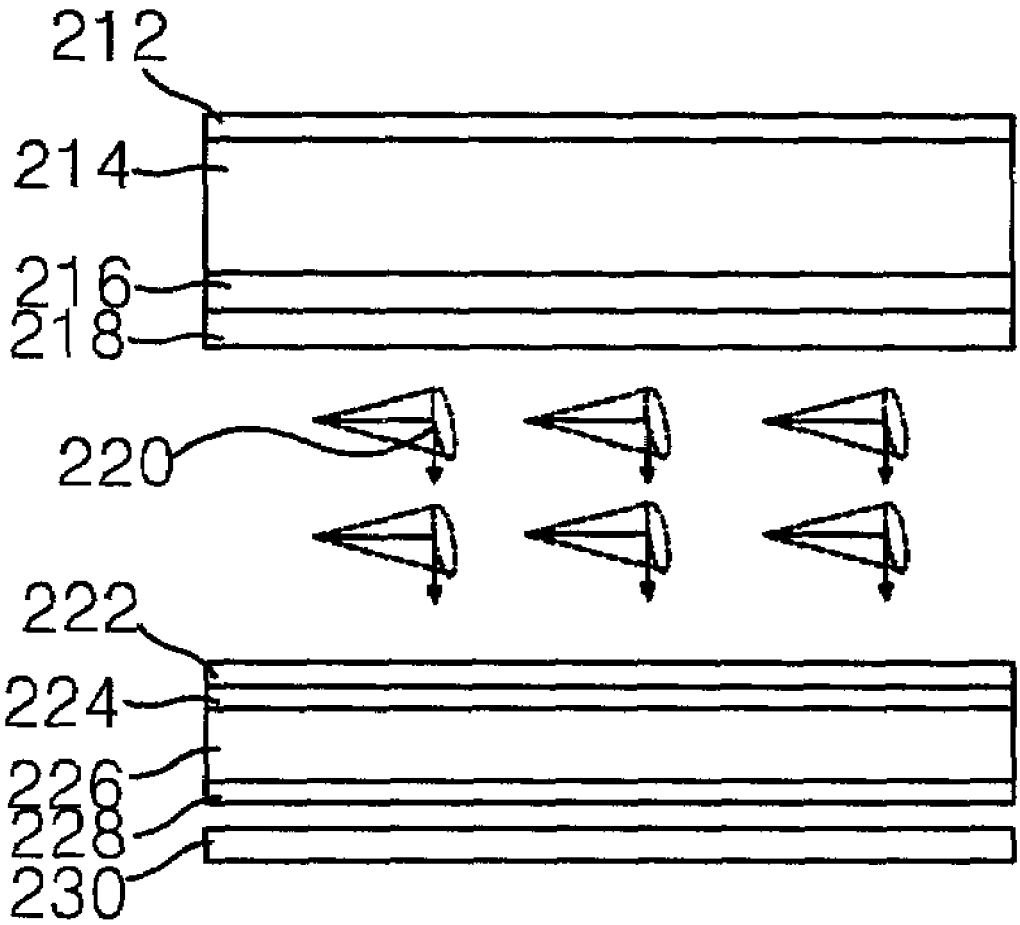

FIG. 13 is a sectional view of the liquid crystal panel shown in FIG. 12.

Figure 14:
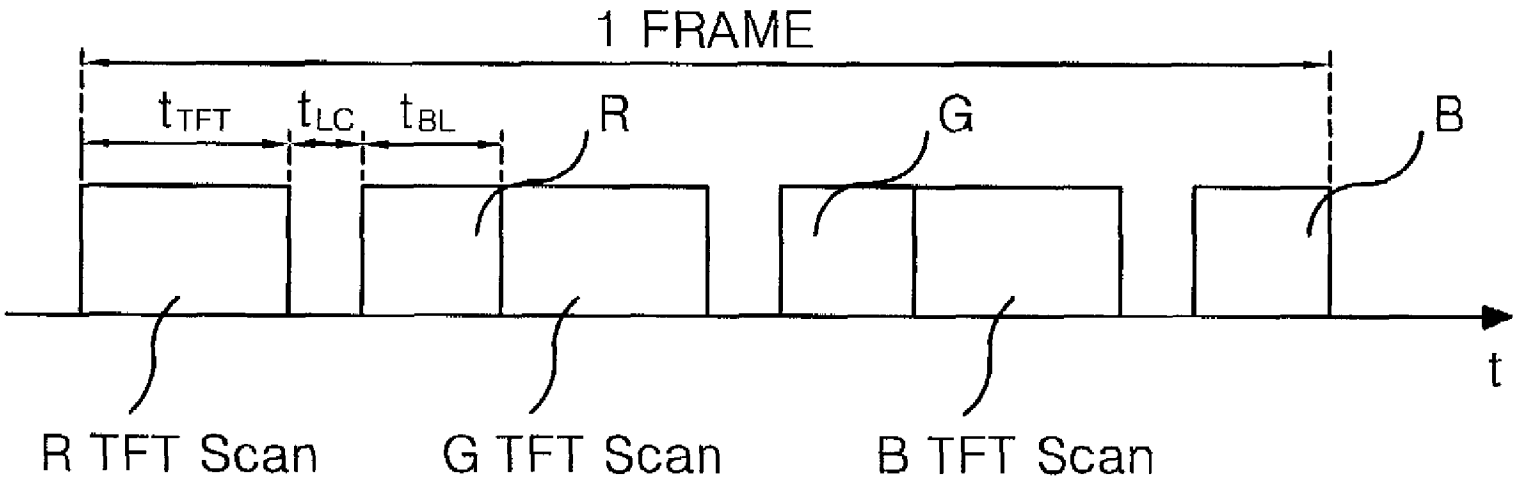

FIG. 14 illustrates the driving method of the ferroelectric liquid crystal display shown in FIG. 12.

Figure 15:
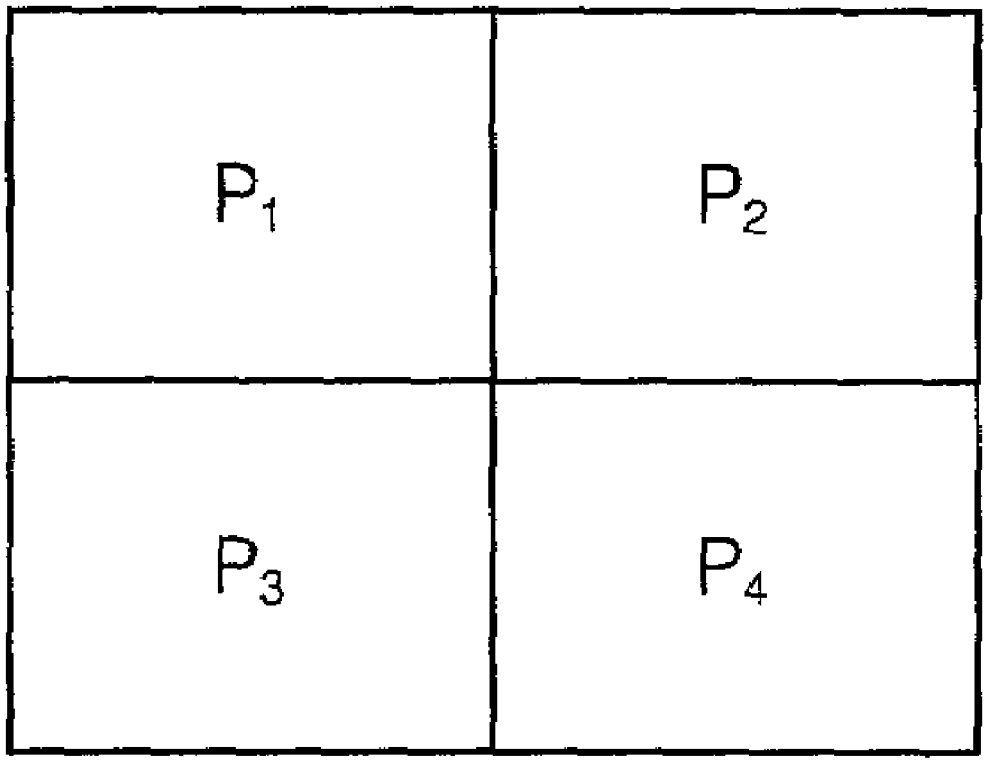

FIG. 15 illustrates the liquid crystal cell shown in FIG. 12.

DETAILED DESCRIPTION OF THE ILLUSTRATED EMBODIMENT

Reference will now be made in detail to an embodiment of the present invention, example of which is illustrated in the accompanying drawings.

FIGS. 12 to 15 illustrate the ferroelectric liquid crystal display and the driving method thereof according to an embodiment of the present invention.

Referring to FIG. 12, the ferroelectric liquid crystal display according to the present invention includes a liquid crystal panel 200, a data driver 202 for supplying a data signal to the liquid crystal panel 200, a gate driver 204 for supplying a scanning signal to the liquid crystal panel 200, a timing controller 208 for supplying the data signal and a control signal to the data driver 202 and a scanning control signal to the gate driver 204, a backlight 210 for irradiating light to the liquid crystal panel 200, a light source driver 206 for driving the backlight 210 sequentially, and a light source controller 211 for controlling the light source driver 206.

The liquid crystal panel 200, as shown FIG. 13, includes a upper substrate 214 on which a common electrode 216 and an alignment film 218 that has undergone an alignment treatment are sequentially disposed; a lower substrate 226 on which a pixel electrode 224 including a TFT array and an alignment film 222 that has undergone an alignment treatment are sequentially disposed; spacers (not shown) provided between the upper substrate 214 and the lower substrate 226; ferroelectric liquid crystal 220 injected into an inner space defined by the spacers between the upper and lower substrate 214 and 226, and polarizers 212 and 228 attached at the outsides of the upper and lower substrates 214 and 226.

The liquid crystal panel 200 also includes liquid crystal cells arranged in a matrix configuration on the lower substrate 226, and thin film transistors (TFTs) as switching elements, which are formed at the crossing area of a plurality gate lines (GL) and a plurality data lines (DL) to switch the data signal supplied to the liquid crystal cell.

Referring again to FIG. 12, the data driver 202 supplies data signals (RGB Data) to the liquid crystal panel 200 corresponding to the control signals inputted from the timing controller 208.

The gate driver 204, in correspondence with the gate signals inputted from the timing controller 208, controls the on/off state of the gate terminal of the TFTs arranged on the liquid crystal panel 200 line by line to have the data signals supplied from the data driver 202 applied to each of the pixels connected to each of the TFT.

The data signals, control signals, an input clock, horizontal synchronization signals, a vertical synchronization signals, and a data enable signals, are inputted from an interface not shown in the drawing are supplied to the timing controller 208.

The timing controller 208 supplies the data signals (RGB Data) and the data enable signals to the data driver 202. The timing controller 208 also receive the horizontal synchronization signals (H) and the vertical synchronization signals (V) and generate a gate start clock (GSC) and a gate scanning pulse (GSP) to supply to the gate driver 204.

In this way, the scanning signals supplied from the gate driver 204 turn on the TFT to supply the data signals (RGB Data) supplied from the data driver 202 to the liquid crystal cells. Accordingly, the arrangement state of the liquid crystal molecule is set in the liquid crystal cell corresponding to the voltage of the data signal (RGB Data) supplied. The light transmitted is controlled according to the arrangement state of the liquid crystal molecule and is synchronized with the data signal by the backlight 210.

The backlight 210 includes red, green and blue light sources 210R, 210G and 210B. The brightness of the backlight 210 is determined. The red, green and blue light sources 210R, 210G and 210B are sequentially turned on and off by the control signal supplied from the backlight controller 211.

The ferroelectric liquid crystal display is described in detail as following in connection with the drawing of the timing of the sequential driving as illustrated in FIG. 14.

Referring to FIG. 14, one frame period of the liquid crystal panel 200 includes the TFT scanning time tTFT of the red, green and blue data signals supplied to the liquid crystal cell, the response time tLC of the liquid crystal corresponding to the red, green and blue data signals, and the time tBL of irradiating the red, green and blue lights.

The red data signal is supplied to the liquid crystal cell at the TFT scanning time tTFT. Accordingly, the ferroelectric liquid crystal is arranged corresponding to the red data signal. For example, the ferroelectric liquid crystal is arranged in response to the red data signal so that red light is irradiated to the liquid crystal panel 200. Because the ferroelectric liquid crystal rapidly discharges the charged voltage due to the VHR characteristics, red light is irradiated in synchronization with the short time of sustaining the on-state of the ferroelectric liquid crystal.

The green data signal is supplied to the liquid crystal cell at the TFT scanning time tTFT. Accordingly, the ferroelectric liquid crystal is arranged corresponding to the green data signal. For example, the ferroelectric liquid crystal arranged in response to the green data signal so that green light is irradiated to the liquid crystal panel 200. Because the ferroelectric liquid crystal rapidly discharges the charged voltage due to the VHR characteristics, green light is irradiated in synchronization with the short time of sustaining the on-state of the ferroelectric liquid crystal.

The blue data signal is supplied to the liquid crystal cell at the TFT scanning time tTFT. Accordingly, the ferroelectric liquid crystal is arranged corresponding to the blue data signal. For example, the ferroelectric liquid crystal arranged in response to the blue data signal so that blue light is irradiated to the liquid crystal panel 200. Because the ferroelectric liquid crystal rapidly discharges the charged voltage due to the VHR characteristics, the blue light is irradiated in synchronization with the short time of sustaining the on-state of the ferroelectric liquid crystal.

The tri-color light is sequentially irradiated to one of the liquid crystal cells during one frame period in the ferroelectric liquid crystal display. It is possible to drive only for one frame period because the response time of the ferroelectric liquid crystal to the voltage applied is considerably short in comparison with the liquid crystal in the nematic phase.

As illustrated in FIG. 15, because the realization of the tri-color of red, green and blue in a certain pixel cell is possible, the sub-pixel corresponding to each of the red, green and blue used in the conventional liquid crystal display is no longer necessary. Consequently, the resolution of the liquid crystal display according to the present invention increases three times as compared to the conventional liquid crystal display for the same resolution.

Also, the red, green and blue color filters are not necessary in the ferroelectric liquid crystal display of the present invention because the backlight uses the primary three colors.

As a result of not using the color filter, light transmittance is increased by approximately 22%. In addition, because red, green and blue lights are sequentially irradiated only for the short time any deterioration in brightness can be compensated during the period the liquid crystal is capable of transmitting the light, i.e., while the required liquid crystal arrangement is sustained. For example, upon the synchronization of the turn-on time of the backlight and the liquid crystal arrangement time, the TFT can drive a ferroelectric liquid crystal having a relatively large spontaneous polarization. The VHR characteristics of the ferroelectric liquid crystal can be compensated by the increase of the size of the spontaneous polarization of the ferroelectric liquid crystal. Therefore, light efficiency can be improved by preventing the deterioration in brightness resulting from the VHR characteristics of the ferroelectic liquid crystal.

As described above, the ferroelectric liquid crystal display according to the present invention sequentially irradiates the red, green and blue lights during the short time when the liquid crystal has an arrangement in which the liquid crystal transmits light, thus preventing deterioration in the brightness resulting from the low voltage holding ratio of the ferroelectric liquid crystal and increasing the efficiency at the same time. The ferroelectric liquid crystal display according to the present invention uses the backlight corresponding to the red, green and blue so as not to require the sub-liquid crystal cell corresponding to each data signal of red, green and blue, and realizes as three times higher resolution as the conventional ferroelectric liquid crystal display with the same number of cells. Furthermore, the ferroelectric liquid crystal display and the driving method thereof according to the present invention does not use color filters so that the light transmittance can be increased by approximately 22% and can reduce the motion blurring phenomenon of a picture upon the display of a moving picture.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A ferroelectric liquid crystal display, comprising:

a liquid crystal panel including liquid crystal and at least one liquid crystal cell arranged at a crossing area of a gate line and a data line;

a data processor always supplying only one color data signal to said at least one liquid crystal cell during a scanning period; and a backlight in a stand-by state throughout the duration of a responding period of the liquid crystal corresponding to the color data signal, wherein the backlight always generates only one colored light after the responding period in correspondence with the color data signals, wherein the color data signal is one of a red, green, and blue color signal, wherein all time intervals between supplying color data signals in the scanning period are substantially equal.

2. The ferroelectric liquid crystal display according to claim 1, wherein said liquid crystal panel comprises:

a upper substrate on which a common electrode and a first alignment film are sequentially disposed; and a lower substrate on which a thin film transistor, a pixel electrode and a second alignment film are sequentially disposed, wherein the liquid crystal is a ferroelectric liquid crystal interposed between said upper substrate and said lower substrate.

3. The ferroelectric liquid crystal display according to claim 1, wherein said backlight includes a backlight driver for supplying an electrical signal to generate red, green and blue light.

4. The ferroelectric liquid crystal display according to claim 1, further comprising a backlight controller for supplying a control signal to generate red, green and blue light.

5. The ferroelectric liquid crystal display according to claim 1, said ferroelectric liquid crystal responds according to said red, green and blue data signals.

6. A method of driving a ferroelectric liquid display, comprising:

supplying always only one color data signal to a liquid crystal cell of a liquid crystal panel, wherein liquid crystal in the liquid crystal cell responds to the color data signal during a responding period for the color data signal; and generating always only one colored light after the responding period, wherein the colored light is generated in correspondence with the color data signals, wherein the color data signal is one of a red, green, and blue color signal, wherein all time intervals between supplying color data signals in a scanning period are substantially equal, wherein a backlight is in a stand-by state during the responding period.

7. The method according to claim 6, wherein said red, green and blue data signals sequentially are applied to the liquid crystal cell at least once during a frame period.

8. The method according to claim 6, wherein the liquid crystal cell includes a ferroelectric liquid crystal.

9. The method according to claim 6, further comprising:

supplying a red data signal to said liquid crystal cell and then irradiating a red light, during a frame period;

supplying a green data signal to said liquid crystal cell and then irradiating a green light, during said frame period; and supplying a blue data signal to said liquid crystal cell and then irradiating a blue light, during said frame period.

10. The method according to claim 9, wherein after each of the red, green and blue data signals is supplied, there is a time for the liquid crystal to respond to each respective data signal, before the next data signal is supplied.

11. The method according to claim 10, wherein after at least one of the red light, green light and blue light is irradiated for a predetermined time, another data signal for another color is immediately supplied.

12. A liquid crystal display device, comprising:

a liquid crystal panel including:

a plurality of gate signal lines;

a plurality of data signal lines;

liquid crystal cells in a matrix at crossing points of the gate and data signal lines, the liquid crystal cells having a liquid crystal therein;

a data driver for supplying data signals to the data signal lines;

a gate driver for supplying gate signals to the gate signal lines;

a controller for receiving a plurality of signals from an interface; and a backlight in a stand-by state throughout the duration of responding periods as the liquid crystal responds to the data signals after the data signals are supplied to the liquid crystal cells and always generating only one colored light after the responding period, wherein all time intervals between supplying data signals in a scanning period are substantially equal.

13. The liquid crystal display device of claim 12, wherein the data signals include red, green and blue data signals.

14. The liquid crystal display device of claim 12, wherein the plurality of signals include a control signal.

15. The liquid crystal display device of claim 12, wherein the plurality of signals include a horizontal synchronization signal.

16. The liquid crystal display device of claim 12, wherein the plurality of signals include a vertical synchronization signal.

17. The liquid crystal display device of claim 12, wherein the plurality of signals include an input clock signal.

18. The liquid crystal display device of claim 12, wherein the plurality of signals include a data enable signal.

19. The liquid crystal display device of claim 12, wherein controller is capable of receiving a horizontal synchronization signal and a vertical synchronization signal and generating a gate start clock and a gate scanning pulse to be supplied to the gate driver.

20. The liquid crystal display device of claim 12, wherein the controller is capable of receiving data signals and generating red, green and blue data signals and a data enable signal to be supplied to the data driver.

* * * * *